United States Patent [19]

Roche et al.

[11] Patent Number: 4,978,607

[45] Date of Patent: Dec. 18, 1990

[54] PHOTOGRAPHIC RECORDING MATERIAL

[75] Inventors: Edouard Roche, Lohmar-Breidt; Wolfgang Himmelmann, Leverkusen; Hans-Theo Buschmann, Cologne; Heinz Quambusch, Leverkusen, all of Fed. Rep. of Germany

[73] Assignee: AGFA-Gevaert Aktiengessellschaft, Leverkusen, Fed. Rep. of Germany

[21] Appl. No.: 239,392

[22] Filed: Sep. 1, 1988

[30] Foreign Application Priority Data

Sep. 10, 1987 [DE] Fed. Rep. of Germany ..... 3730319

[51] Int. Cl.[5] ..... G03C 1/30

[52] U.S. Cl. ..... 430/642; 430/961; 430/451

[58] Field of Search ..... 430/642, 451, 961

[56] References Cited

U.S. PATENT DOCUMENTS

| | | | |
|---|---|---|---|
| 4,021,244 | 5/1977 | Nagatomo et al. | 430/642 |
| 4,021,245 | 5/1977 | Nagatomo et al. | 430/642 |
| 4,119,464 | 10/1978 | Sauerteig et al. | 430/451 |

*Primary Examiner*—Paul R. Michl
*Assistant Examiner*—Thoel Chea
*Attorney, Agent, or Firm*—Connolly & Hutz

[57] ABSTRACT

A photographic recording material which comprises at least one gelatin-containing silver halide emulsion layer and at least one protective layer containing a gelatin derivative, the protective layer being further away from the layer support than each silver halide emulsion layer and 30 to 90% of the amino groups of the gelatin in the gelatin derivative being reacted with a monofunctional acid derivative, and which is hardened with an instant hardener can be produced at high speed and, hence, at high drying temperatures without any reticulation grain occurring during processing.

2 Claims, No Drawings

PHOTOGRAPHIC RECORDING MATERIAL

This invention relates to a photographic recording material which comprises a protective layer containing a gelatin derivative and which is hardened by an instant hardener.

It is known that the layers of photographic recording materials can be hardened using hardeners from a number of classes. The instant hardeners described, for example, in DE-PSS Nos. 22 25 230 and 24 39 551 are particularly advantageous.

It is also known that, instead of gelatin, gelatin derivatives may be used in protective layers, the derivatives being obtained by reaction of alkali- or acid-limed gelatin with monofunctional isocyanates, aziridines and sulfonyl chlorides (U.S. Pat. No. 3,923,517).

This is said to allow rapid processing of the exposed material at temperatures of at least 30° C. without any loss of quality of the photographic materials (color negative films, color reversal films, color negative paper, etc.).

This is possible as long as certain drying temperatures are not exceeded in the production of the photographic material. However, where the temperatures applied are relatively high through increases in the production rate, the known process is no longer successful; instead, unwanted reticulated grain occurs during the processing of such material.

The object of the present invention is to provide a photographic material which can be economically produced, i.e. at high speeds and hence at high drying temperatures, but which nevertheless does not develop any reticulated grain during processing irrespective of the processing temperatures applied.

According to the invention, this object is achieved in that gelatin of which the amino groups are only reacted to a certain extent with monofunctional acid derivatives is used in the protective layer and in that the photographic recording material is hardened with an instant hardener. The instant hardener may be applied in a separate hardening layer or may be added to the casting solution for the protective layer.

Accordingly, the present invention relates to a photographic recording material comprising at least one gelatin-containing silver halide emulsion layer and at least one protective layer containing a gelatin derivative, the protective layer being further away from the layer support than each silver halide emulsion layer, characterized in that 30 to 90% of the amino groups of the gelatin in the gelatin derivative are reacted with a monofunctional acid derivative and the photographic recording material is hardened with an instant hardener.

More particularly, the degree of reaction of the amino groups may be from 60 to 85% and may be achieved by reacting gelatin with the corresponding quantity of monofunctional acid derivative or by reacting the gelatin to a higher degree than required and then mixing it with unreacted gelatin or with a gelatin which has been reacted to a lower degree than required.

More particularly, 50 to 100% by weight gelatin derivative and 0 to 50% by weight gelatin are used.

Suitable photographic recording materials are color negative films, color reversal films, color positive films, color photographic paper, color reversal photographic paper, color-sensitive materials for the dye diffusion transfer process or a silver dye bleaching process and black-and-white photosensitive materials, such as black-and-white films, X-ray films, process films, black-and-white photographic paper, air films or air image films, microfilms, facsimile films, films and photographic paper for the photocompositions, films for graphics, etc.

However, the advantage obtainable is particularly clear for color negative paper.

Instant hardeners are understood to be compounds which crosslink suitable binders in such a way that, immediately after coating or after 24 hours at the latest and preferably after 8 hours, hardening has progressed to such an extent that there is no further change in the sensitometry and swelling of the layer set through the crosslinking reaction. Swelling is understood to be the difference between the wet layer thickness and the dry layer thickness in the aqueous processing of the photographic material (Photogr. Sci. Eng. 8 (1964), 275; Photogr. Sci. Eng. 16 (1972), 449).

These hardeners which react very quickly with gelatin are, preferably, carboxyl-activating crosslinking agents, for example carbamoyl pyridinium salts which are capable of reacting with free carboxyl groups of the protein-like binder so that they are able to react with free amino groups with formation of peptide bonds and crosslinking of the binder.

Suitable examples of instant hardeners are compounds corresponding to the following general formulae:

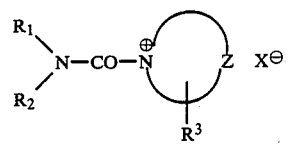

(a)

in which $R_1$ is alkyl, aryl or aralkyl, $R_2$ has the same meaning as $R_1$ or is alkylene, arylene, aralkylene or alkaralkylene, the second bond being attached to a group corresponding to the following formula

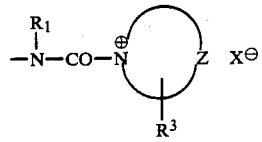

or $R_1$ and $R_2$ together represent the atoms required to complete an optionally substituted heterocyclic ring, for example a piperidine, piperazine or morpholine ring, the ring optionally being substituted, for example, by $C_1$–$C_3$ alkyl or halogen, $R_3$ is hydrogen, alkyl, aryl, alkoxy, $—NR_4—COR_5$, $—(CH_2)_m—NR_8R_9$, $—(CH_2)_n—CONR_{13}R_{14}$ OR $$—(CH_2)_p—\underset{\underset{R_{15}}{|}}{CH}—Y—R_{16}$$

or is a bridge member or a direct bond to a polymer chain, $R_4$, $R_6$, $R_7$, $R_9$, $R_{14}$, $R_{15}$, $R_{17}$, $R_{18}$ and $R_{19}$ being hydrogen or $C_1$–$C_4$ alkyl, $R_5$ being hydrogen, $C_1$–$C_4$ alkyl or $NR_6R_7$, $R_8$ being $—COR_{10}$, $R_{10}$ being $NR_{11}R_{12}$, $R_{11}$ being $C_1$–$C_4$ alkyl or aryl, particularly phenyl, $R_{12}$ being hydrogen, $C_1$–$C_4$ alkyl or aryl, particularly phenyl, $R_{13}$ being hydrogen, $C_1$–$C_4$ alkyl or aryl, particularly phenyl, $R_{16}$ being hydrogen, $C_1$–$C_4$ alkyl, $COR_{18}$ or $CONHR_{19}$, m being a number of 1 to 3, n being a number of 0 to 3, p being a number of 2 to 3 and Y being 0 or $NR_{17}$ or $R_{13}$ and $R_{14}$ together representing the atoms required to complete an optionally substituted heterocyclic ring, for example a piperidine, piperazine or morpholine ring, the ring optionally being substituted, for example, by $C_1$–$C_3$ alkyl or halogen Z being the C-atoms required to complete a 5-membered or 6-membered aromatic heterocyclic ring, optionally with a linked benzene ring; and $X^\theta$ is an anion which may be attached to the rest of the molecule by a covalent bond;

(b) 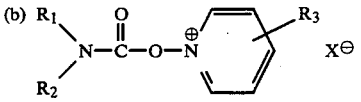

in which $R_1$, $R_2$, $R_3$ and $X^\theta$ are as defined for formula (a);

(c) 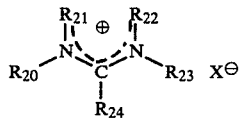

in which $R_{20}$, $R_{21}$, $R_{22}$, $R_{23}$ are $C_1$–$C_{20}$ alkyl, $C_6$–$C_{20}$ aralkyl, $C_5$–$C_{20}$ aryl, in each case unsubstituted or substituted by halogen, sulfo, $C_1$–$C_{20}$ alkoxy, N,N-di-$C_1$–$C_4$-alkyl-substituted carbamoyl and, in the case of aralkyl and aryl, by $C_1$–$C_{20}$ alkyl, $R_{24}$ is a group releasable by a nucleophilic agent and $X^\theta$ is as defined for formula (a); 2 or 4 of the substituents $R_{20}$, $R_{21}$, $R_{22}$ and $R_{23}$ together with a nitrogen atom or the group

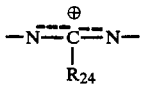

may even be closed to form of one or two saturated, 5- to 7-membered rings, optionally with inclusion of other heteroatoms, such as O or N;

(d) $R_{25}$—N=C=N—$R_{26}$ in which $R_{25}$ is $C_1$–$C_{10}$ alkyl, $C_5$–$C_8$ cycloalkyl, $C_3$–$C_{10}$ alkoxyalkyl or $C_7$–$C_{15}$ aralkyl, $R_{26}$ has the same meaning as $R_{25}$ or is a radical corresponding to the following formula

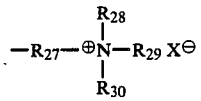

where $R_{27}$ is $C_2$–$C_4$ alkylene and $R_{28}$, $R_{29}$ and $R_{30}$ are $C_1$–$C_6$ alkyl; one of the substituents $R_{28}$, $R_{29}$ and $R_{30}$ may be substituted by a carbamoyl group or a sulfo group and two of the substituents $R_{28}$, $R_{29}$ and $R_{30}$ may be attached together with the nitrogen atom to form an optionally substituted heterocyclic ring, for example a pyrrolidine, piperazine or morpholine ring, the ring optionally being substituted, for example, by $C_1$–$C_3$ alkyl or halogen, and $X^\theta$ is as defined for formula (a);

(e) 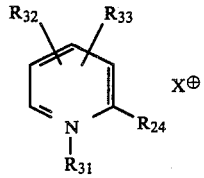

in which $X^\theta$ is as defined for formula (a), $R_{24}$ is as defined for formula (c), $R_{31}$ is $C_1$–$C_{10}$ alkyl, $C_6$–$C_{15}$ aryl or $C_7$–$C_{15}$ aralkyl, in each case unsubstituted or substituted by carbamoyl, sulfamoyl or sulfo, $R_{32}$ and $R_{33}$ are hydrogen, halogen acylamino, nitro, carbamoyl, ureido, alkoxy, alkyl, alkenyl, aryl or aralkyl or, together, represent the remaining members of a ring, more especially a benzene ring, fused to the pyridinium ring;

$R_{24}$ and $R_{31}$ may be attached to one another where $R_{24}$ is a sulfonyloxy group;

(f) 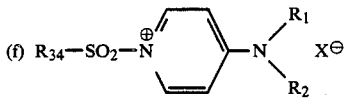

in which $R_1$, $R_2$ and $X^\theta$ are as defined for formula (a) and $R_{34}$ is $C_1$–$C_{10}$ alkyl, $C_6$–$C_{14}$ aryl or $C_7$–$C_{15}$ aralkyl;

(g) 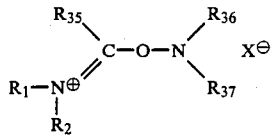

in which $R_1$, $R_2$ and $X^\theta$ are as defined for formula (a), $R_{35}$ is hydrogen, alkyl, aralkyl, aryl, alkenyl, $R_{38}O$—, $R_{39}R_{40}$, $R_{41}R_{42}C$=N— or $R_{38}S$—, $R_{36}$ and $R_{37}$ are alkyl, aralkyl, aryl, alkenyl,

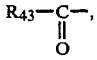

$R_{44}$—$SO_2$ or $R_{45}$—N=N— or together with the nitrogen atom, are the remaining members of a heterocyclic ring or the group

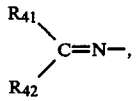

$R_{38}$, $R_{39}$, $R_{40}$, $R_{41}$, $R_{42}$, $R_{43}$, $R_{44}$ and $R_{45}$ being alkyl, aralkyl, alkenyl, in addition to which $R_{41}$ and $R_{42}$ may be hydrogen and $R_{39}$ and $R_{40}$ or $R_{41}$ and $R_{42}$ may be the remaining members of a 5-membered or 6-membered, saturated carbocyclic or heterocyclic ring;

(h)

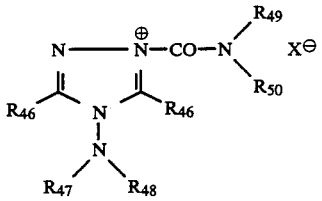

in which $R_{46}$ is hydrogen, alkyl or aryl, $R_{47}$ is acyl, carbalkoxy, carbamoyl or aryloxycarbonyl;

$R_{48}$ is hydrogen or $R_{47}$, $R_{49}$ and $R_{50}$ are alkyl, aryl, aralkyl or, together with the nitrogen atom, represents the remaining members of an optionally substituted heterocyclic ring, for example a piperidine, piperazine or morpholine ring, the ring optionally being substituted, for example, by $C_1$–$C_3$ alkyl or halogen, and $X^\theta$ is as defined for formula (a).

Finally, suitable instant hardeners are the compounds described in published Japanese application Nos. 38 540/75, 93 470/77, 43 353/81 and 113 929/83 and in U.S. Pat. No. 3,321,313.

Unless otherwise defined, alkyl is, in particular, $C_1$–$C_{20}$ alkyl optionally substituted by halogen, hydroxy, sulfo, $C_1$–$C_{20}$ alkoxy.

Unless otherwise defined, aryl is, in particular, $C_6$–$C_{14}$ aryl optionally substituted by halogen, sulfo, $C_1$–$C_{20}$ alkoxy or $C_1$–$C_{20}$ alkyl Unless otherwise defined, aralkyl is, in particular, $C_7$–$C_{20}$ aralkyl substituted by halogen, $C_1$–$C_{20}$ alkoxy, sulfo or $C_1$–$C_{20}$ alkyl. Unless otherwise defined, alkoxy is in particular $C_1$–$C_{20}$ alkoxy.

$X^\theta$ is preferably a halide ion, such as $Cl^\theta$, $Br^\theta$ or $BF_4^\theta$, $NO_3^\theta$, $(SO_4^{2\theta})_{\frac{1}{2}}$, $ClO_4^\theta$, $CH_3OSO_3^\theta$, $PF_6^\theta$, $CF_3SO_3^\theta$ and, in particular, an $SO_3^\theta$ group attached to the hardener molecule by a covalent bond; the $SO_3^\theta$ group may be attached via a substituent (see definitions of alkyl, aryl, aralkyl) or, in formulae (a), (b) and (c), may be directly attached to the heterocycle.

Alkenyl is, in particular, $C_2$–$C_{20}$ alkenyl. Alkylene is, in particular, $C_2$–$C_{20}$ alkylene; arylene is, in particular, phenylene, aralkylene is, in particular, benzylene and alkaralkylene is, in particular, xylylene.

Suitable N-containing ring systems represented by Z are shown on the previous page. The pyridine ring is preferred.

$R_{36}$ and $R_{37}$ together with the nitrogen atom to which they are attached form in particular a benzene-, cyclohexene or [2.2.1]-bicyclohexene-fused pyrrolidine or piperidine ring . . . by two oxo groups attached in the o- and o'-position.

Acyl is, in particular, $C_1$–$C_{10}$ alkyl carbonyl or benzoyl; carbalkoxy is, in particular, $C_1$–$C_{10}$ alkoxycarbonyl; carbamoyl is, in particular, mono- or di-$C_1$–$C_4$-alkylaminocarbonyl; carbaroxy is, in particular, phenoxycarbonyl.

Groups $R_{24}$ releasable by nucleophilic agents are, for example, halogen atoms, $C_1$–$C_{15}$ alkyl sulfonyloxy groups, $C_7$–$C_{15}$ aralkyl sulfonyloxy groups, $C_6$–$C_{15}$ aryl sulfonyloxy groups and 1-pyridinyl radicals.

It is of advantage to combine the instant hardeners, particularly those of the carbonyl-activating crosslinking agent type, with the bis- or poly-functional conventional hardeners. The bis- and polyfunctional crosslinking agents either may have been introduced into the hardening layer or may have been incorporated in one or more emulsion or intermediate layers. Bisfunctional crosslinking agents are understood to be the following compounds for example:

$H_1$ $CH_2{=}CH{-}SO_2{-}CH_2{-}SO_2{-}CH{=}CH_2$ $H_2$ $CH_2{=}CH{-}SO_2{-}CH_2{-}O{-}CH_2{-}SO_2{-}CH{=}CH_2$ $H_3$

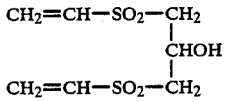

$H_4$ $CH_2{=}CH{-}SO_2{-}CH_2{-}CO{-}NH$ $H_5$ $CH_2{=}CH{-}SO_2{-}CH_2{-}CO{-}NH$ $H_6$

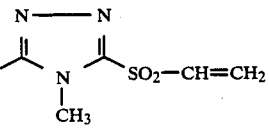

-continued

H7 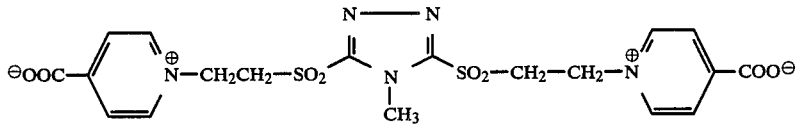

H8 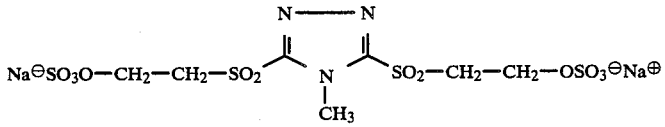

H9 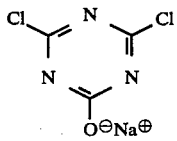

H10 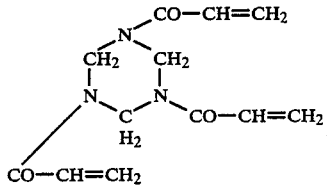

H11 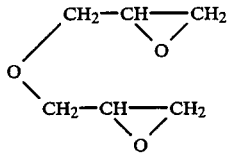

The compounds are added in quantities of up to 50% by weight, based on instant hardener.

Particularly suitable, conventional polyfunctional crosslinking agents are compounds corresponding to the following formula $$R_{51}\text{-}[\text{-}SO_2\text{-}CH{=}CH_2]_q$$

in which $R_{51}$ is an optionally substituted heteroaromatic ring containing at least q ring C-atoms and at least one ring O, ring S or ring N atom, and q is an integer of $\geqq 2$.

The heteroaromatic ring represented by $R_{51}$ is, for example, a triazole, thiadiazole, oxadiazole, pyridine, pyrrol, quinoxaline, thiophene, furane, pyrimidine or triazine ring. In addition to the at least two vinyl sulfonyl groups, it may optionally contain other substituents and, optionally fused benzene rings which, in turn, may also be substituted. The following are examples of heteroaromatic rings ($R_{51}$):

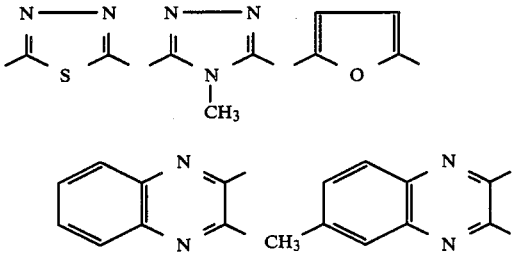

-continued

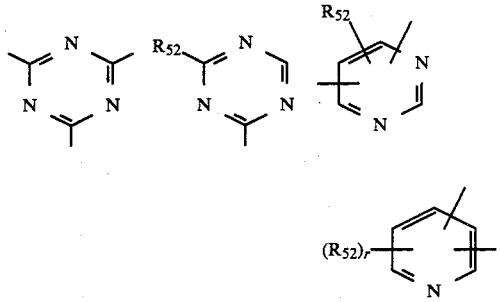

in which r is a number of 0 to 3 and $R_{52}$ is $C_1$–$C_4$ alkyl, $C_1$–$C_4$ alkoxy or phenyl.

The term "gelatin" used herein for the starting material for the gelatin derivative according to the invention relates to the protein substance emanating from collagen. However, this term is also intended to encompass other substantially equivalent substances, for example synthetic gelatin. In general, gelatin is classified as alkaline gelatin which is obtained from collagen, for example by treatment with calcium hydroxide, acidic gelatin which is obtained by acidic treatment, for example with hydrochloric acid, enzymatic gelatin which is treated, for example, with a hydrolase and low molecular weight gelatin which is obtained by further hydrolysis of the gelatins mentioned above by different methods. Each of the gelatins mentioned above may be used for the preparation of the gelatin derivatives required in accordance with the invention.

The monofunctional compounds required for the preparation of the gelatin derivative used in accordance with the invention may be any compounds containing one functional group per molecule which is capable of reacting with an amino group present in the gelatin molecule. The gelatin derivatives thus prepared are substantially equivalent in regard to the practical application of the invention. Representative functional groups are, for example, —NCO, —NCS, —NHCOSO$_3$M or —NHCS—SO$_3$M, where M is an alkali metal atom, for example a sodium or potassium atom,

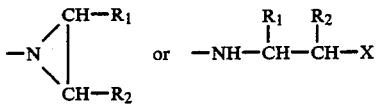

where $R_1$ and $R_2$ each represent a hydrogen atom or a lower alkyl radical, for example containing up to 4 carbon atoms, such as a methyl or ethyl group, and X is a halogen atom, for example a chlorine or bromine atom,

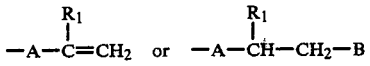

where $R_1$ is as defined above, A is an electron-attracting substituent which activates a vinyl group, for example a halogen atom, such as a chlorine or bromine atom, an acetyloxy or sulfonate group, and B is an atom or several atoms which, where eliminated as acid, are capable of forming a vinyl group with the hydrogen atom attached to the adjacent carbon atom, —SO$_2$X, where X is as defined above, —COX, where X is as defined,

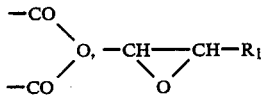

in which $R_1$ is as defined above,

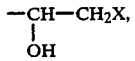

where X is as defined above, —X, where X is as defined above, —COOR$_3$, where $R_3$ is as an aryl radical containing an electron-attracting group in the o- or p-position, for example

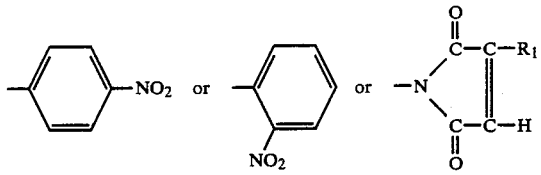

in which $R_1$ is as defined above.

The following are representative examples of compounds containing a functional group which are suitable for the preparation of the gelatin derivatives used in accordance with the invention:

isocyanates, such as phenyl isocyanate, p-tolyl isocyanate, 4-bromophenyl isocyanate, 4-chlorophenyl isocyanate, 2-nitrophenyl isocyanate, 4-methoxycarbonyl phenyl isocyanate, 1-naphthyl isocyanate, phenyl isocyanate-bisulfite adduct, p-biphenyl isocyanate-bisulfite adduct or intermediate stages thereof;

isothiocyanates, such as phenyl isothiocyanate, p-tolyl isothiocyanate, phenyl isothiocyanate-bisulfite adduct or intermediate stages thereof;

sulfonyl halides, such as the aryl sulfonyl halides, for example benzene sulfonyl chloride, 4-methoxybenzene sulfonyl chloride, 4-phenoxybenzene sulfonyl chloride, 4-chlorobenzene sulfonyl chloride, 4-bromobenzenesulfonyl chloride, 4-methylbenzene sulfonyl chloride, 3-nitrobenzene sulfonyl chloride, 3-carboxybenzene sulfonyl chloride, 2-naphthalene sulfonyl chloride, 4-aminobenzene sulforyl fluoride, 3,4-diaminobenzene sulfonyl fluoride or 3-carboxybenzene sulfonyl fluoride, and the lower alkyl sulfonyl halides, such as methane sulfonyl chloride or ethane sulfonyl chloride; carboxylic acid halides, such as the aryl carboxylic acid halides, for example 4-nitrobenzoyl chloride or 4-carboxybenzoyl bromide; and the aliphatic carboxylic acid halides, such as butyric acid chloride, caproic acid chloride or caprylic acid chloride;

carboxylic anhydrides, for example aromatic or aliphatic carboxylic anhydrides, such as succinic anhydride, phthalic anhydride, hexahydrophthalic anhydride, isatoic anhydride, monomethyl succinic anhydride, glutaric anhydride, benzoic anhydride, trimellitic anhydride, 3,6-dichlorophthalic anhydride, diglycolic anhydride or nitrophthalic anhydride; compounds containing active halogen which correspond, for example, to the general formula D—X, in which X is a halogen atom and D is a substituent capable of activating the substituent for example —CH$_2$COOH or

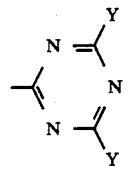

in which Y is a lower alkoxy radical; an aryloxy radical, such as a phenoxy group; a mono (lower alkyl) amino group; a di (lower alkyl) amino group or a monoaryl amino group, such as

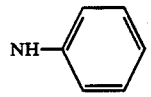

such as bromoacetic acid, chloroacetic acid, 2-chloro-4,6-dimethoxy- 1,3,5-triazine or 2-chloro-4,6-diethylamino-1,3,5-triazine;

activated esters of carboxylic acids, for example of aromatic or aliphatic acids, such as o-nitrophenyl benzoate, p-nitrophenyl acetate or p-nitro-1-hydroxynaphthoate; and maleic acid imides, such as N-ethyl maleic acid imide, N-phenyl maleic acid imide, N-(p-carboxyphenyl)-maleic acid imide, N-(p-sulfophenyl)-maleic acid imide or N-(carboxymethyl)-maleic acid imide.

These compounds may be used for chemically modifying the gelatin by the method described hereinafter.

Of the compounds mentioned above, isocyanates, such as phenyl isocyanate or p-tolyl isocyanate, sulfonyl halides, such as benzene sulfonyl chloride, 4-methoxybenzene sulfonyl chloride, 4-chlorobenzene sulfonyl chloride, 4-bromobenzene sulfonyl chloride or 4-methylbenzene sulfonyl chloride, and also carboxylic acid chlorides and carboxylic anhydrides are particularly preferred.

The gelatin derivatives required for carrying out the invention may be produced using conventional methods by reacting gelatin with the monofunctional compounds mentioned above in solvents for gelatin, such as water, organic solvents, for example dimethyl sulfoxide, dimethyl formamide or acetic acid, or a mixture of organic solvents and water, optionally in the presence of a base or an acid as pH regulator. The process mentioned above for producing the gelatin derivatives used in accordance with the invention is the same process as described in U.S. Pat. Nos. 2,594,293, 2,614,929, 2,763,639, 3,118,766, 3,132,945 and 3,186,846, in GB-PSS No. 648,926 and 976,391 and published JA-PA No. 26 845/67 or a similar process.

The degree of reaction of the $NH_2$ groups is generally determined by the VAN SLYKE N-value (J. BIOL. CHEM. 73; 121–6) or by titration with formol (KENCHINGTON in A LABORATORY MANUAL OF ANALYTICAL METHODS OF PROTEIN CHEMISTRY, VOL. 2, pp 353–88, PERGAMON PRESS LONDON, 1960, and NINHYDRIN COLORIMETRY (COBBETT 1964, J. Appl. Chem. 14; 296–302).

The photographic emulsion layers of the photographic, photosensitive materials according to the invention may contain any silver halide, such as silver bromide, silver bromoiodide, silver bromochloroiodide, silver bromochloride and silver chloride. Preferred silver halides are silver bromochloride and silver bromochloroiodide which contain 3 mol-% silver iodide or less.

The silver halide particles in the photographic emulsion may be so-called regular particles having a regular crystalline form, such as a cubic, octahedral or tetradecahedral form, or particles having a spherical or other irregular crystalline form or may have a double-face or other crystal defect. The particles may also be composite particles encompassing the various crystal forms mentioned above.

The silver halide particles may be fine (particle size 0.1 μm or smaller) or coarse (particle size up to 10 μm). They may form a monodisperse emulsion having a narrow particle size distribution or a polydisperse emulsion having a broad particle size distribution.

The photographic silver halide emulsions which may be used in accordance with the invention may be prepared by known methods of the type described in Research Disclosure (RD), no. 17643 (December 1978), pages 22 to 23 "I. Emulsion Preparation and Types" and RD no. 18716 (November 1979), page 648.

In addition, the photographic emulsions used in accordance with the invention may be prepared by other known methods of the type described in Chemie et Physique Photographique (P. Glafkides, published by Paul Montel, 1967). Photographic Emulsion Chemistry (G. F. Duffin, published by Focal Press, 1966) and Making and Coating Photographic Emulsion (V. L. Zelikman et al., published by Focal Press, 1964). In particular, they may be prepared by any acid process neutral process or ammonia process. It is also possible to use a one-sided mixing process, a simultaneous mixing process or a combination thereof to react a soluble silver salt and a soluble halide in the presence of a solution containing a water-soluble substance of high molecular weight, such as a gelatin solution. A so-called reverse mixing process, in which silver halide particles are formed in the presence of excess silver ions, may also be used.

A so-called controlled double-jet process may also be used. This process is a form of simultaneous mixing process in which the pAg value is kept constant in the liquid phase to form silver halide particles. It is possible by this process to obtain an emulsion containing silver halide particles having a substantially regular crystalline form and a substantially uniform particle size.

Two or more types of silver halide emulsions which have been separately prepared may be mixed.

In the case of color photographic recording materials, the emulsions may be chemically and spectrally sensitized in the usual way.

Color photographic recording materials normally contain at least one silver halide emulsion layer for recording light of each of the three spectral regions red, green and blue. To this end, the photosensitive layers are spectrally sensitized in known manner by suitable sensitizing dyes. Blue-sensitive silver halide emulsion layers need not necessarily contain a spectral sensitizer because, in many cases, the natural sensitivity of the silver halide is sufficient for recording blue light.

Each of the photosensitive layers mentioned may consist of a single layer or, in known manner, for example as in the so-called double layer arrangement, may also comprise two or even more partial silver halide emulsion layers (No. DE-C1 121 470). Normally, red-sensitive silver halide emulsion layers are arranged nearer the layer support than green-sensitive silver halide emulsion layers which in turn are arranged nearer than blue-sensitive emulsion layers, a non-photosensitive yellow filter layer generally being arranged between the green-sensitive layers and blue-sensitive layers. However, other arrangements are also possible. A non-photosensitive intermediate layer, which may contain agents to prevent the unwanted diffusion of developer oxidation products, is generally arranged between layers of different spectral sensitivity. Where several silver halide emulsion layers of the same spectral sensitivity are present, they may be arranged immediately adjacent one another or in such a way that a photosensitive layer of different spectral sensitivity is present between them (Nos. DE-A-1 958 709, DE-A-2 530 645, DE-A-2 622 922).

Color photographic recording materials for the production of multicolor images by chromogenic development normally contain dye-producing compounds, in the present case particularly color couplers, for producing the different component dye images cyan, magenta and yellow in spatial and spectral association with the silver halide emulsion layers of different spectral sensitivity.

In the context of the invention, spatial association means that the color coupler is present in such a spatial relationship to the silver halide emulsion layer that the two are capable of interacting in such a way as to allow imagewise accordance between the silver image formed during development and the dye image produced from the color coupler. This result is generally achieved by the fact that the color coupler is contained in the silver halide emulsion layer itself or in an adjacent optionally non-photosensitive binder layer.

By spectral association is meant that the spectral sensitivity of each of the photosensitive silver halide emulsion layers and the color of the component dye image produced from the particular spatially associated color coupler bear a certain relationship to one another, a component dye image relating to another color (generally for example the colors cyan, magenta or yellow in that order) being associated with each of the spectral sensitivities (red, green, blue).

One or more color couplers may be associated with each of the differently spectrally sensitized silver halide emulsion layers. Where several silver halide emulsion layers of the same spectral sensitivity are present, each of them may contain a color coupler, the color couplers in question not necessarily having to be the same. They are merely required to produce at least substantially the same color during color development, normally a color which is complementary to the color of the light to which the silver halide emulsion layers in question are predominantly sensitive.

In preferred embodiments, therefore, at least one non-diffusing color coupler for producing the cyan component dye image, generally a coupler of the phenol or $\alpha$-naphthol type, is associated with red-sensitive silver halide emulsion layers. At least one non-diffusing color coupler for producing the magenta component dye image, normally a color coupler of the 5-pyrazolone, the indazolone or the pyrazolotriazole type, is associated with green-sensitive silver halide emulsion layers. Finally, at least one non-diffusing color coupler for producing the yellow component dye image, generally a color coupler containing an open-chain ketomethylene group, is associated with blue-sensitive silver halide emulsion layers. The color couplers may be 2- and 4-equivalent couplers. Color couplers of this type are known in large numbers and are described in a number of patent specifications, cf. for example No. DE-A 3 630 165, which shows a number of other literature references.

The couplers may be incorporated in the coating solution of the silver halide emulsion layers or other colloid layers in known manner. For example, the oil-soluble or hydrophobic couplers may be added to a hydrophilic colloid solution, preferably from a solution in a suitable high-boiling coupler solvent (oil former), optionally in the presence of a wetting agent or dispersant. Besides the binder, the hydrophilic coating solution may of course contain other standard additives. The solution of the coupler does not have to be directly dispersed in the coating solution for the silver halide emulsion layer or any other water-permeable layer. Instead, it may with advantage first be dispersed in an aqueous non-photosensitive solution of a hydrophilic colloid and the resulting mixture subsequently mixed before application, optionally after removal of the low-boiling organic solvent used with the coating solution for the photosensitive silver halide emulsion layer or another water-permeable layer.

Examples of suitable high-boiling organic solvents are phthalates (such as dibutyl phthalate, dicyclohexyl phthalate, di-2-ethyl hexyl phthalate and decyl phthalate), phosphates and phosphonates (such as triphenyl phosphate, tricresyl phosphate, 2-ethyl hexyl diphenyl phosphate, tricyclohexyl phosphate, tri-2-ethyl hexyl phosphate, tridecyl phosphate, tributoxyethyl phosphate, trichloropropyl phosphate and di-2-ethyl hexyl phenyl ptosphonate), benzoates (such as 2-ethyl hexyl benzoate, dodecyl benzoate and 2-ethyl hexyl-p-hydroxybenzoate), amides (such as diethyl dodecane amide and N-tetradecyl pyrrolidone), alcohols and phenols (such as isostearyl alcohol and 2,4-di-tert.-amylphenol), aliphatic carboxylic acid esters (such as dioctyl azelate, glycerol tributyrate, isostearyl lactate and trioctyl citrate), aniline derivatives (such as N,N-dibutyl-2-butoxy-5-tert.-octyl aniline) and hydrocarbons (such as paraffin, dodecyl benzene and diisopropyl naphthalene).

The layers may also contain wetting agents, for example anionic, amphoteric or nonionic wetting agents. Particularly suitable wetting agents correspond to the following formulae

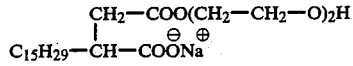

dodecylbenzene sulfonate

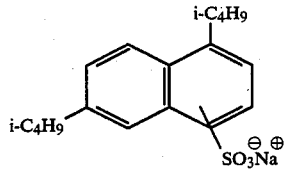

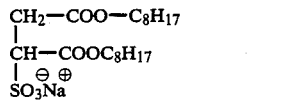

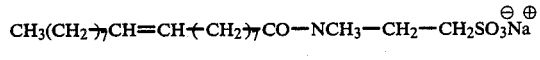

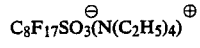

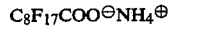

In addition to the constituents mentioned, the color photographic recording material may contain other additives, for example antioxidants, dye stabilizers, agents for influencing the mechanical and electrostatic properties, lubricants, matting agents and optical brighteners. Many of these additives are described in detail in DE-A-No. 3 630 165 to which reference is made here. To reduce or avoid the adverse effect of UV light on the dye images produced with the color photographic recording material according to the invention, it is of advantage to use UV-absorbing compounds in one or more of the layers present in the recording material, preferably in one of the upper layers. Suitable UV absorbers are described, for example, in U.S. Pat. No. 3,253,921, DE-C-No. 2 036 719 and EP-A-No. 0 057 160.

To produce color photographic images, the color photographic recording material according to the invention is developed with a color developer compound. Suitable color developer compounds are any developer compounds which are capable of reacting in the form of their oxidation product with color couplers to form azomethine dyes. Suitable color developer compounds are aromatic compounds containing at least one primary amino group of the p-phenylenediamine type, for example N,N-dialkyl-p-phenylenediamines, such as N,N-di-ethyl-p-phenylenediamine, 1-(N-ethyl-N-methylsulfonamido-ethyl-3-methyl-p-phenylenediamine, 1-(N-ethyl-N-hydroxyethyl-3-methyl-p-phenylenediamine and 1-(N-ethyl-N-methoxyethyl)-3-methyl-p-phenylenediamine.

After color development, the material is bleached and fixed in the usual way. Bleaching and fixing may be carried out separately or even together. Suitable bleaches are any of the usual compounds, for example $Fe^{3+}$ salts and $Fe^{3+}$ complex salts, such as ferricyanides, dichromates, water-soluble cobalt complexes, etc. Particularly preferred bleaches are iron(III) complexes of aminopolycarboxylic acids, more especially for example ethylenediamine tetraacetic acid, N-hydroxyethyl ethylenediamine triacetic acid, alkyliminodicarboxylic acids, and of corresponding phosphonic acids. Other suitable bleaches are persulfates.

After the silver removal step (bleach fixing or fixing), the material is washed and/or stabilized. Various compounds may be used for various purposes in the washing step and in the stabilizing step. Reference is made in this connection to DE-A-No. 3 630 165.

The instant hardener is used in a quantity corresponding to 2 to 4% by weight of the total amount of gelatin present over the layer support.

EXAMPLE 1

A first (bottom) to fifth layer were applied as described in the following to a paper double-laminated with polyethylene. Various sixth layers (top layer) differing in their composition as shown in Table I were used to prepare various photosensitive materials.

The emulsion for the first layer was prepared as follows;

100 g of a yellow coupler were dissolved in a mixture of 100 ml dibutyl phthalate and 200 ml ethyl acetate. The solution was dispersed in 800 g of a 10% by weight aqueous gelatin solution containing 80 ml of a 1% by weight aqueous solution of sodium dodecylbenzene sulfonate. The emulsion thus obtained was then mixed with 1450 g (70 g as Ag) of a blue-sensitive chlorobromide emulsion containing 88 mol-% Br. The other emulsions containing other couplers were similarly prepared.

The emulsions were applied to a support.

Each photosensitive material thus prepared was exposed to blue light, green light and red light in such a way that the color density formed after development was 1.0 and was then processed in an automatic developing machine as described in the following.

| | Processing steps | |
|---|---|---|
| | Temp. (°C.) | Time (mins) |
| Development | 33 | 3.5 |
| Bleach-fixing | 33 | 1.5 |
| Rinsing | 38–35 | 3 |

The composition of the processing solution is as follows:

| Developer | |
|---|---|
| Benzyl alcohol | 15 ml |
| Diethylene glycol | 8 ml |
| Ethylenediamine tetraacetic acid | 5 g |
| Sodium sulfite | 2 g |
| Anhydrous potassium carbonate | 30 g |
| Hydroxylamine sulfate | 3 g |
| Potassium bromide | 0.6 g |
| 4-Amino-N-ethyl-N-(β-methanesulfonamidoethyl)-m-toluidine-2/3-sulfuric acid salt monohydrate | 5 g |
| Adjusted to pH 10.2 water q.s.f. | 1 l |

-continued

| Bleach-fixing bath | |
|---|---|
| Ethylenediamine tetraacetic acid | 2 g |
| Iron (III) ethylenediamine tetraacetate | 40 g |
| Sodium sulfite | 5 g |
| Ammonium sulfate | 70 g |
| Water q.s.f. | 1 l |

In addition, after a processing bath had been introduced into the automatic, developing machine, standard commercial color papers were processed for several days, after which each photosensitive material was developed in a state in which one of the transport rollers of the automatic developing machine was soiled.

After development, the degree of soiling of the surface of the photosensitive material was determined and the formulation of reticulation grain visually assessed The results are shown in Table I.

Layer structure

5th Layer (red-sensitive layer)

300 mg/m² (expressed as Ag) of a silver chlorobromide emulsion (Br: 50 mol-%), 1,000 mg/m, gelatin, 400 mg/m² cyan coupler and 200 mg/m² dibutyl phthalate.

4th Layer (intermediate layer)

1,200 mg/m² gelatin, 100 mg/m² of an ultraviolet absorber and 250 mg/m² dibutyl phthalate.

3rd Layer (green-sensitive layer)

290 mg/m² (expressed as Ag) of a silver chlorobromide emulsion (Br: 50 mol-%), 1,000 mg/m² gelatin, 200 mg/m² of a magenta coupler and 200 mg/m² tricresyl phosphate.

2nd Layer (intermediate layer)

1,000 mg/m² gelatin

1st Layer (blue-sensitive layer)

400 mg/m² (expressed as Ag) of a silver chlorobromide emulsion (Br: 80 mol-%), 1,200 mg/m±gelatin, 300 mg/m² of a yellow coupler and 150 mg/m² dioctyl butyl phosphate.

Support

Paper support double-laminated with polyethylene.

Cyan coupler: 2-[α-(2,4-di-tert.-pentylphenoxy)-butaneamido-4,6-dichloro-5-methylphenol.

Ultra-violet absorber: 2-(2-hydroxy-3-sec.-butyl-5-tert.-butylphenyl)-benzotriazole.

Magenta coupler: 1-(2,4,6-trichlorophenyl)-3-(2-chloro-5-tetradecaneamido)-anilino-2-pyrazolin-5-one.

Yellow coupler: α-pivaloyl-α-(2,4-dioxo-5,5'-dimethyloxazolin-3-yl)-2-chloro-5-[(2,4-di-tert.-pentylphenoxy)butaneamido]-acetanilide.

Either an integrated hardening protective layer (sample or a protective layer system consisting of two layers (samples 1 to 6) was coated onto the fifth layer of the layer set.

The composition of the layers is shown in Table I below.

A=alkali-limed gelatin having an IEP of 4.9; quantity applied 1.0 g/m²

B=acid-limed gelatin having ar IEP of 8.9; quantity applied 1.0 g/m²

(IEP=isoelectric point)

C=phenylureido gelatin; 80% of the $NH_2$ groups of the starting gelatin are reacted with phenyl isocyanate; quantity applied 1.0 g/m$^2$ D=gelatin derivative; 80% of the $NH_2$ groups were reacted with acetic anhydride; quantity applied 1.0 g/m$^2$ E=gelatin derivative; 80% of the $NH_2$ groups were reacted with phthalic anhydride; quantity applied 1.0 g/m$^2$ F=gelatin derivative; 100% of the amino groups are reacted with phenyl isocyanate; quantity applied 1.0 g/m$^2$ G=instant hardener corresponding to the following formula

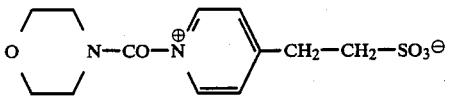

quantity applied 0.35 g/m$^2$

H=surface-active wetting agent corresponding to the following formula:

$$C_8F_{17}SO_3^{\theta}(N(C_2H_5)_4)^{\theta}$$

quantity applied per layer 10 mg/m$^2$

I=lubricant: polysiloxane dispersion in water 0.1 mg/m$^2$

The drying temperature of the material during the drying process was 25° C. in each case. All the layers contained various amounts of anionic coating wetting agents according to the surface tension adjusted.

TABLE I

| Samples | Protective layer layer composition | Hardening layer layer composition | Results: reticulation grain | gloss | soiling |
|---|---|---|---|---|---|
| Comparison sample 1 | A H | G I | extensive | 30% | light |
| Comparison sample 2 | B H | G I | none | 90% | heavy |
| Sample 3 according to the invention | C H | G I | none | 91% | light |
| Sample 4 according to the invention | D H | G I | none | 88% | light |
| Comparison sample 5 | E H | G I | extensive | 60% | light |
| Comparison sample 6 | F H | G I | extensive | 23% | heavy |
| Sample 7 according to the invention | C G H I | — | none | 90% | light |

It can be seen from Table I that neither the alkali-limed gelatin nor the acid-limed gelatin is totally satisfactory.

Although the alkali-limed gelatin showed no soil uptake, it did show extensive reticulation grain. The acid-limed gelatin shows opposite behavior.

Only the layers according to the invention of incompletely reacted gelatin derivatives showed no reticulation grain and virtually no soil uptake. Gelatin derivatives of dicarboxylic acids could not be used and even completely derivatized gelatins (>90% of the amino groups reacted) showed serious dissolution of the layer and, at the same time, high soil uptake on account of the poor hardenability.

EXAMPLE 2

A layer set was prepared as described in Example 1 and a system of two layers coated therein as the sixth layer. The composition of the layers is shown in Table II below.

After coating the layer melting points were determined by the following method.

The layer set coated onto a support is semi-immersed in water continuously heated to 100° C. The temperature at which the layer runs off the support (streaking) is the layer melting point. Using this method, unhardened protein layers show no increase whatever in melting point. The layer melting point under these conditions is 30° to 35° C.

The layer constituents A, C, G, H and I correspond to Example 1.

J=acetyl gelatin from alkali-limed gelatin; 70% of the amino groups are reacted with acetic anhydride; quantity applied 1.0 g/m$^2$ K=acetyl gelatin from alkali-limed gelatin; 30% of the amino groups are reacted with acetic anhydride; quantity applied 1.0 g/m$^2$ L=conventional hardener H 8; quantity applied 0.35 g/m$^2$ M=convention hardener H 3; quantity applied 0.35 g/m$^2$ N=conventional hardener H 8; quantity applied 0.1 g/m$^2$

TABLE II

| Code | Samples | Protective layer layer composition | Hardening layer layer composition | Results: Layer melting point after coating | reticulation grain | gloss | Soiling |
|---|---|---|---|---|---|---|---|
| C | sample 1 | A H | G I | >100° C. | extensive | 30% | light |
| I | sample 2 | C H | G I | >100° C. | none | 86% | light |
| I | sample 3 | J H | G I | >100° C. | none | 80% | light |

TABLE II-continued

| Code | Samples | Protective layer layer composition | Hardening layer layer composition | Results: Layer melting point after coating | reticulation grain | gloss | Soiling |
|---|---|---|---|---|---|---|---|
| C | sample 4 | K H | G I | >100° C. | extensive | 30% | light |
| C | sample 5 | A H | L I | 36° C. | none | 86% | heavy |
| C | sample 6 | C H | L I | 36° C. | none | 86% | light |
| I | sample 7 | C H | G + N I | >100° C. | none | 86% | light |
| C | sample 8 | C H | M I | 36° C. | extensive | 30% | light |

I = Invention
C = Comparison

It can be seen from Table II that the protective layers prepared with conventional crosslinking agents H 3 and H 8 are not hardened immediately after coating and drying and dissolve during processing at >36° C. Accordingly, they are of only limited use. Crosslinking is only complete after prolonged storage (post-hardening). Accordingly, uniform adjustment of the degree of swelling is only possible by laborious tests. The mixture according to the invention of carboxyl-containing hardeners and conventional hardeners and the simultaneous use of gelatin derivatives as layer binders for the protective layer produce optimal behavior in regard to melting point, reticulation grain, gloss and soil uptake.

We claim:

1. A photographic recording material comprising at least one gelatin-containing silver halide emulsion layer and at least one protective layer containing a gelatin derivative, the protective layer being further away from the layer support than each silver halide emulsion layer, characterized in that 60 to 85% of the amino groups of the gelatin in the gelatin derivative are reacted with a monofunctional acid derivative and the photographic recording material is hardened with a hardener corresponding to the following formula

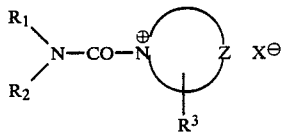

in which $R_1$ is alkyl, aryl or aralkyl, $R_2$ has the same meaning as $R_1$ or is alkylene, arylene, aralkylene or alkaralkylene, the second bond being attached to a group corresponding to the following formula

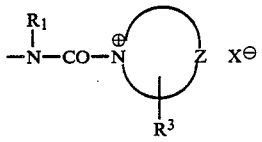

or $R_1$ and $R_2$ together represent the atoms required to complete a piperidine, piperazine or morpholine ring, the ring optionally being substituted by $C_1$–$C_3$ alkyl or halogen, $R_3$ represents hydrogen, alkyl, aryl, alkoxy —$NR_4$–$COR_5$, —$(CH_2)_m$—$NR_8R_9$, —$(CH_2)_n$—$CONR_{13}R_{14}$ or $$-(CH_2)_p-\underset{\underset{R_{15}}{|}}{CH}-Y-R_{16}$$

or is a bridge member or a direct bond to a polymer chain, $R_4$, $R_6$, $R_7$, $R_9$, $R_{14}$, $R_{15}$, $R_{17}$, $R_{18}$ and $R_{19}$ being hydrogen or $C_1$–$C_4$ alkyl, $R_5$ being hydrogen, $C_1$–$C_4$ alkyl or $NR_6R_7$, $R_8$ being —$COR_{10}$, $R_{10}$ being $NRIIR_{12}$, $R_{11}$ being $C_1$–$C_4$ alkyl or aryl, $R_{12}$ being hydrogen, $C_1$–$C_4$ alkyl or aryl, $R_{13}$ being hydrogen, $C_1$–$C_4$ alkyl or aryl, $R_{16}$ being hydrogen, $C_1$–$C_4$ alkyl, $COR_{18}$ or $CONHR_{19}$, m being a number of 1 to 3, n being a number of 0 to 3, p being a number of 2 to 3 and Y being 0 or $NR_{17}$, or $R_{13}$ and $R_{14}$ together representing the atoms required to complete a piperidine, piperazine or morpholine ring, the ring optionally being substituted by $C_1$–$C_3$ alkyl or halogen, Z representing the carbon atoms required to complete a 5- or 6-membered aromatic heterocyclic ring, optionally with a linked benzene ring, and $X^{\theta}$ is an anion which may be attached to the rest of the molecule by a covalent bond.

2. A photographic recording material as claimed in claim 1, characterized in that the instant hardener is used in a quantity of 2 to 4% by weight of the total amount of gelatin present over the layer support.

* * * * *